US006713220B2

(12) United States Patent
Graham et al.

(10) Patent No.: US 6,713,220 B2
(45) Date of Patent: Mar. 30, 2004

(54) PHOTOCONDUCTIVE MEMBERS

(75) Inventors: John F. Graham, Oakville (CA); Zoran D. Popovic, Mississauga (CA); Ah-Mee Hor, Mississauga (CA); James M. Duff, Mississauga (CA); Satchidanand Mishra, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/151,124

(22) Filed: May 17, 2002

(65) Prior Publication Data

US 2003/0215727 A1 Nov. 20, 2003

(51) Int. Cl.[7] ..... G03G 15/02

(52) U.S. Cl. ..... 430/58.25

(58) Field of Search ..... 430/58.25

(56) References Cited

U.S. PATENT DOCUMENTS

| | | | | |
|---|---|---|---|---|
| 3,121,006 | A | 2/1964 | Middleton et al. | 96/1 |
| 4,265,990 | A | 5/1981 | Stolka et al. | 430/59 |
| 4,362,798 | A | 12/1982 | Anderson et al. | 430/59 |
| 4,555,463 | A | 11/1985 | Hor et al. | 430/59 |
| 4,587,189 | A | 5/1986 | Hor et al. | 430/59 |
| 5,473,064 | A | 12/1995 | Mayo et al. | 540/141 |
| 5,482,811 | A | 1/1996 | Keoshkerian et al. | 430/135 |
| 5,521,306 | A | 5/1996 | Burt et al. | 540/141 |
| 5,756,245 | A | 5/1998 | Esteghamatian et al. | 430/59 |
| 6,004,708 | A | 12/1999 | Bellino et al. | 430/58.45 |
| 6,080,518 | A | 6/2000 | Levin et al. | 430/58.4 |
| 6,171,741 | B1 | 1/2001 | Evans et al. | 430/58.35 |

*Primary Examiner*—Mark A. Chapman
(74) *Attorney, Agent, or Firm*—E. O. Palazzo

(57) ABSTRACT

A photoconductive imaging member comprised of a supporting substrate, a photogenerating layer and a charge transport layer, and wherein said charge transport layer contains a component that substantially prevents light of a wavelength of about equal to or about less than 700 nanometers from interaction with said photogenerating layer.

33 Claims, No Drawings

PHOTOCONDUCTIVE MEMBERS

RELATED PATENTS

Illustrated in U.S. Pat. No. 5,756,245, the disclosure of which is totally incorporated herein by reference, is a photoconductive imaging member comprised of a hydroxygallium phthalocyanine photogenerator layer, a charge transport layer, a barrier layer, a photogenerator layer comprised of a mixture of bisbenzimidazo(2,1-a-1',2'-b)anthra(2,1,9-def:6,5, 10-d'e'f')diisoquinoline-6, 11-dione and bisbenzimidazo(2,1-a:2',1'-a)anthra(2,1,9-def:6,5,10-d'e'f')diisoquinoline-10,21-dione, and thereover a charge transport layer.

Illustrated in U.S. Pat. No. 5,521,306, the disclosure of which is totally incorporated herein by reference, is a process for preparation of Type V hydroxygallium phthalocyanine comprising the in situ formation of an alkoxybridged gallium phthalocyanine dimmer, hydrolyzing the dimmer to hydroxygallium phthalocyanine and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine which comprises hydrolyzing a gallium phthalocyanine precursor pigment by dissolving said hydroxygallium phthalocyanine in a strong acid and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the present invention in embodiments thereof.

BACKGROUND OF THE INVENTION

This invention is generally directed to imaging members, and more specifically, the present invention is directed to photoconductive imaging members with, for example, improved resistance to light shock and a method of using the imaging member. Light shock refers, for example, to a phenomena in which a photoresponsive imaging member when exposed to room light exhibits an increase in dark decay, depletion, increased sensitivity, collapse of the photoinduced discharge curve (PIDC) tail, and reduced residual potential $V_{residual}$. The exposure to room light, may occur, for example, during installation of the photoreceptor or during servicing of a machine, such as a xerographic machine. Thus, for example, during belt replacement or machine maintenance, nonuniform exposure of the photoreceptor to room light can result in nonuniformity in the electrical properties of the imaging member. A difference in electrical properties between exposed areas of an imaging member is undesirable because it can cause nonuniform image potentials which in turn leads to the formation of nonuniform toner images when the light shocked imaging member is subsequently utilized for electrophotographic imaging. More specifically, the present invention relates to imaging members containing a dopant in the charge transport layer, and wherein the charge generation layer is resistant to or there is an avoidance of light shock, especially at from about 400 to 500 nanometers of light, and which light can adversely affect the photogenerating pigments present in the charge generating layer. In embodiments, the dopant or additive component added or contained in the transport layer absorbs light of wavelength less than about 700 nanometers. In embodiments the dopant or additive component added or contained in the transport layer absorbs light with a wavelength shorter than about 460 nanometers; and also wherein the dopant or additive component present in the charge transport layer is a diphenoquinone, which for example will prevent or minimize any light with a wavelength between about 400 nanometers to about 460 nanometers from interacting with the photogenerating layer. Examples of photogenerating pigments include hydroxygallium phthalocyanines, such as Type V hydroxygallium phthalocyanine. Processes of imaging, especially xerographic imaging, and printing, including digital, are also encompassed by the present invention.

Also, more specifically, the layered photoconductive imaging members of the present invention can be selected for a number of different known imaging and printing processes including, for example, multicopy/fax devices, electrophotographic imaging processes, especially xerographic imaging and printing processes wherein negatively charged or positively charged images are rendered visible with toner compositions of an appropriate charge polarity. The imaging members are in embodiments sensitive in the wavelength region of, for example, from about 400 to about 900 nanometers, and in particular, from about 550 to about 830 nanometers, thus IR diode lasers can be selected as the light source. Moreover, the imaging members of the present invention in embodiments can be selected for color xerographic imaging applications where several color printings can be achieved in a single pass.

REFERENCES

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene pigment photogenerating component. Both of the aforementioned patents disclose an aryl amine component as a hole transport layer.

Illustrated in U.S. Pat. No. 6,171,741, the disclosure of which is totally incorporated herein by reference, is an electrophotographic imaging member containing in the charge transport layer a light shock resisting additive of triethanolamine, morpholine, an imidazole or mixtures thereof.

Illustrated in U.S. Pat. No. 4,362,798 is a process for electrophotographic reproduction, and a layered electrophotographic plate having a charge generation layer and a p-type hydrazone containing charge transport layer. The charge transport layer can contain DEASP or Acetosol Yellow in an amount not exceeding about 13 percent by weight.

Illustrated in U.S. Pat. No. 6,004,708 is a photoconductor which exhibits reduced room light and cycling fatigue. The photoconductor includes fluorenyl-azine derivatives in the charge transport layer.

Illustrated in U.S. Pat. No. 6,080,518 is a photoconductor containing quinone additives in either the charge generation layer, the charge transport layer, or both.

The appropriate components and processes of the above prior art patents may be selected for the present invention in embodiments thereof.

SUMMARY OF THE INVENTION

It is a feature of the present invention to provide imaging members thereof with many of the advantages illustrated herein.

Another feature of the present invention relates to the provision of layered photoresponsive imaging members with excellent photosensitivity to near infrared radiations, and wherein light wavelengths emitted in the visible region are absorbed in the charge transport layer and prevented from interacting with, or entering into, in embodiments, the photogenerating layer.

Yet another feature of the present invention relates to the provision of layered photoresponsive imaging members with excellent photosensitivity to near infrared radiations, and wherein light wavelengths emitted in the blue region are absorbed in the charge transport layer and prevented from interacting with the photogenerating layer. Blue light is the primary cause of light shock, which refers, for example, to a change in the photoreceptor's electrical properties after prolonged exposure to room light.

In a further feature of the present invention there are provided imaging members containing a photogenerating pigment of Type V hydroxygallium phthalocyanine, especially with XRPD peaks at, for example, Bragg angles (2 theta+/−0.2°) of 7.4, 9.8, 12.4, 16.2, 17.6, 18.4, 21.9, 23.9, 25.0, 28.1, and the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements; (counts) represents the intensity of the diffraction as a function of Bragg angle as measured with a proportional counter.

In still a further feature of the present invention there are provided photoresponsive, or photoconductive imaging members, which can be selected for imaging processes including color xerography.

Aspects of the present invention relate to a photoconductive imaging member comprised of a supporting substrate, a photogenerating layer and a charge transport layer, and wherein the charge transport layer contains a component that substantially prevents undesirable light of, for example, a wavelength of about equal to or about less than 700 nanometers, such as from about 400 to about 500 nanometers from interaction with the photogenerating layer; a photoconductive member with a photogenerating layer of a thickness of from about 0.1 to about 10 microns, a transport layer is of a thickness of from about 5 to about 100 microns, and the interaction prevention prevents or minimizes the amount of undesirable light from contacting the photogenerating layer; a photoconductive member in a dopant component is present in the charge transport layer in an amount of from about 0.1 to about 5 weight percent; an imaging method and an imaging apparatus containing a charging component, a development component, a transfer component, and a fixing component, and wherein the apparatus contains a photoconductive imaging member comprised of supporting substrate, and thereover a layer comprised of a photogenerator pigment and a charge transport layer and which charge transport layer contains a diphenoquinone dopant; a photoconductive imaging member comprised of a supporting substrate, a photogenerating layer and a charge transport layer, and wherein the charge transport layer contains a component that prevents light of a wavelength of about equal to or about less than 700 nanometers from interaction with the photogenerating layer; a member wherein the photogenerating layer is of a thickness of from about 0.1 to about 10 microns, the transport layer is of a thickness of from about 5 to about 100 microns, and the interaction prevention prevents or minimizes the amount of the light from contacting the photogenerating layer; a member wherein the component is present in an amount of from about 0.1 to about 5 weight percent; a member wherein the photogenerating layer contains a photogenerating pigment present in an amount of from about 5 to about 95 weight percent, and wherein the component is a diphenoquinone present in an amount of from about 0.1 to about 1 weight percent; a member wherein the thickness of the photogenerator layer is from about 0.1 to about 5 microns; a member wherein the photogenerating layer contains a polymer binder; a member wherein the binder is present in an amount of from about 50 to about 90 percent by weight, and wherein the total of all components is about 100 percent; a member wherein the photogenerating component is a hydroxygallium phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the binder is selected from the group consisting of polyesters, polyvinyl butyrals, polycarbonates, polystyrene-b-polyvinyl pyridine, and polyvinyl formulas; an imaging member wherein the photogenerator is a metal free phthalocyanine; an imaging member wherein the charge transport comprises

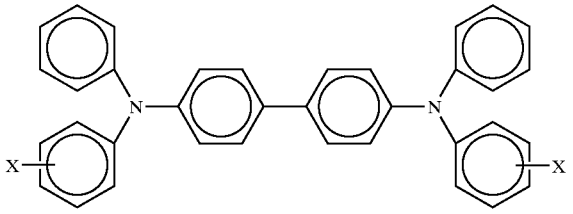

wherein X is selected from the group consisting of alkyl and halogen; an imaging member wherein alkyl contains from about 1 to about 10 carbon atoms; an imaging member wherein alkyl contains from about 1 to about 5 carbon atoms; an imaging member wherein alkyl is methyl; an imaging member wherein the diphenoquinone is a 3,3',5,5'-tetra-tert-butyl-4,4'-diphenoquinone of the formula

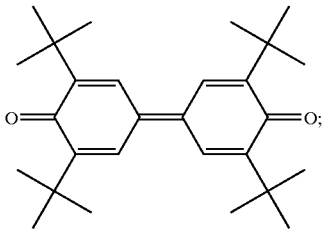

an imaging member wherein the component is a diphenoquinone, and wherein the diphenoquinone absorbs light of a wavelength of from about 400 to about 460 nanometers, and wherein this absorption enables the avoidance or minimization of light shock to the charge transport layer; an imaging member wherein the photogenerating pigment present in the photogenerating layer is comprised of Type V hydroxygallium phthalocyanine prepared by hydrolyzing a gallium phthalocyanine precursor by dissolving the hydroxygallium phthalocyanine in a strong acid and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; an imaging member wherein the component is present in an amount of from about 0.5 to about 0.9 weight percent in the transport layer, and which transport layer contains a resin binder, and wherein the component is diphenoquinone; a method of imaging which comprises generating an electrostatic latent image on the imaging member developing the latent image, and transferring the developed electrostatic image to a suitable substrate; a method of imaging wherein the imaging member is exposed to light of a wavelength of from about 370 to about 950 nanometers; an imaging apparatus containing a charging component, a development component, a transfer component, and a fixing component, and wherein the apparatus contains a photoconductive imaging member comprised of supporting substrate, and thereover a layer comprised of a photogenerator pigment and a charge transport layer, and which charge transport layer contains a diphenoquinone; a member comprised of a supporting substrate, a photogenerating layer and a charge transport layer, and wherein the charge transport layer contains a dopant that absorbs light of a wavelength of from about 400 to about 600 nanometers; a member wherein the photogenerating layer is situated between the substrate and the charge transport; a member wherein the charge transport layer is situated between the substrate and the photogenerating layer; a member wherein the component is a dopant of a diphenoquinon, and which dopant is present in the transport layer in an amount of from about 0.5 to about 0.9 weight percent, and which dopant prevents light of a wavelength of from about 400 to about 700 nanometers from entering the photogenerating layer; a member wherein the photogenerating layer contains a hydroxygallium phthalocyanine; a photoconductive imaging member comprised of a photogenerator layer and a charge transport layer and wherein the photogenerating layer contains a photogenerating pigment or pigments, and the charge transport layer contains a light absorbing dopant; a member wherein the photogenerating layer is of a thickness of from about 0.1 to about 50 microns; a member wherein the photogenerator component amount is from about 0.05 weight percent to about 20 weight percent and wherein the photogenerating pigment is optionally dispersed in from about 10 weight percent to about 80 weight percent of a polymer binder; a member wherein the thickness of the photogenerating layer is from about 1 to about 10 microns; a member wherein the photogenerating and charge transport layer components are contained in a polymer binder; a member wherein the binder is present in an amount of from about 50 to about 90 percent by weight and wherein the total of components is about 100 percent; a member wherein the photogenerating layer contains a hydroxygallium phthalocyanine which absorbs light of a wavelength of from about 550 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the binder is selected from the group consisting of polyesters, polyvinyl butyrals, polycarbonates, polystyrene-b-polyvinyl pyridine, and polyvinyl formulas; an imaging member wherein the photogenerating component is Type V hydroxygallium phthalocyanine; an imaging member wherein the photogenerating component is Type V hydroxygallium phthalocyanine, and the charge transport layer contains a hole transport of N,N'-diphenyl-N,N-bis(3-methyl phenyl)-1,1'-biphenyl-4,4'-diamine molecules and a dopant which will absorb light in the region, from about 400 up to about 575 nanometers of light, such dopants including diphenoquinones, 3,3',5,5'-tetra-tert-butyl4,4'-diphenoquinone (DPQ) or 5,6,11,12-tetraphenyinaphthacene (Rubrene), 2,2'-[cyclohexylidenebis[(2-methyl-4, 1-phenylene)azo]]bis[4-cyclohexyl-(9Cl), perinones, perylenes, dibromo anthanthrone (DBA); an imaging member wherein the Type V hydroxygallium phthalocyanine is prepared by hydrolyzing a gallium phthalocyanine precursor by dissolving the hydroxygallium phthalocyanine in a strong acid and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; an imaging member wherein the photogenerating component further contains a metal free phthalocyanine; an imaging member wherein the photogenerating component further contains an alkoxygallium phthalocyanine; a method of imaging which comprises generating an electrostatic latent image on the imaging member of the present invention, developing the latent image, and transferring the developed electrostatic image to a suitable substrate; a method of imaging wherein the imaging member is exposed to light of a wavelength of from about 550 to about 950 nanometers; an imaging apparatus containing a charging component, a development component, a transfer component, and a fixing component and wherein the apparatus contains a photoconductive imaging member comprised of supporting substrate, and thereover a layer comprised of a photogenerating pigment or mixtures thereof, such as a hydroxygallium photogenerator component; an imaging member further containing an adhesive layer and a hole blocking layer; an imaging member wherein the blocking layer is contained as a coating on a substrate and wherein the adhesive layer is coated on the blocking layer; an imaging member further containing an adhesive layer and a hole blocking layer; a method of imaging which comprises generating an electrostatic latent image on the imaging member of the present invention, developing the latent image, and transferring the developed electrostatic image to a suitable substrate; a color method of imaging which comprises generating an electrostatic latent image on the imaging member, developing the latent image, transferring and fixing the developed electrostatic image to a suitable substrate; and photoconductive imaging members comprised of an optional supporting substrate, a charge transport layer comprised of a mixture of transport molecules and a dopant which absorbs from about 400 to about 500 nanometers light from penetrating to the charge generation layer, and a photogenerating layer comprised of hydroxygallium phthalocyanine or an alkoxygallium phthalocyanine.

Examples of photogenerating components are metal free phthalocyanines, metal phthalocyanines, and more specifically, hydroxygallium phthalocyanine, alkoxygallium phthalocyanine, hydroxygallium dimers, vanadyl phthalocyanine, and chloroindium phthalocyanine. The photogenerating components and the charge transport components are preferably dispersed in a suitable binder, such as polycarbonates, polyesters, polyvinylbutaryl, polysiloxanes and polyurethanes.

The dopant can be present in the charge transport layer in a manner such that the dopant absorbs the majority of the light of a wavelength of, for example, from about 400 to about 700 nanometers, and more specifically, from about 400 to about 500 or to about 460 nanometers. Suitable dopant are quinones, rubrene, yellow dyes, red dyes, orange and red pigments such as DBA, perylenes and perinones; a diphenoquinone; and which dopant can be present in various effective amounts, such as in an amount of from about 0.1 weight percent to about 0.9 weight percent, and more specifically, is present in the charge transport layer in an amount of from about 0.5 weight percent to about 0.9 weight percent, and wherein the polymer binder can be present in an amount of from about 30 weight percent to about 90 weight percent, and more specifically, in an amount of from about 40 weight percent to about 60 weight percent.

Examples of the additive or dopant are the diphenoquinones of the following formula, which diphenoquinones do not significantly adversely affect the residual voltage or cycling stability of the photoreceptor, and wherein the diphenoquinone can be obtained from a number of sources, such as 3,3',5,5'-tetra-tert-butyl-4,4'-diphenoquinone from H. W. Sands Corporation

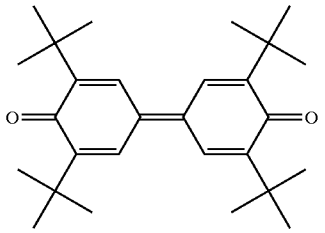

There may also be selected for the members of the present invention a suitable adhesive layer, preferably situated between the substrate and the generating layer, examples of adhesives being polyesters, such as VITEL® PE100 and PE200 available from Goodyear Chemicals, and especially MOR-ESTER 49,000® available from Norton International. This adhesive layer can be coated on to the supporting substrate from a suitable solvent, such as tetrahydrofuran and/or dichloromethane solution to enable a thickness thereof ranging, for example, from about 0.001 to about 5 microns, and more specifically, from about 0.1 to about 3 microns.

The photoconductive imaging members can be economically prepared by a number of methods, such as the coating of the components from a dispersion, and more specifically, as illustrated herein. Thus, the photoresponsive imaging members of the present invention can in embodiments be prepared by a number of known methods, the process parameters being dependent, for example, on the member desired. The photogenerating components for the imaging members can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours, under stationary conditions or in an air flow. The coating can be accomplished to provide a final coating thickness of from about 0.01 to about 30 microns after drying. The fabrication conditions for a given photoconductive layer can be tailored to achieve optimum performance and cost in the final members. The coating of the layer with a mixture of charge transport molecules, dopant and optional binder in embodiments of the present invention can also be accomplished with spray, dip or wire-bar methods such that the final dry thickness of layer is, for example, from about 3 to about 50 microns and preferably from about 5 to about 30 microns after being dried at, for example, about 40° C. to about 150° C. for about 5 to about 90 minutes.

Imaging members of the present invention are useful in various electrostatographic imaging and printing systems, particularly those conventionally known as xerographic processes. Specifically, the imaging members of the present invention are useful in xerographic imaging processes wherein the photogenerating component like the Type V hydroxygallium phthalocyanine pigment absorbs light of a wavelength of from about 550 to about 950 nanometers, and preferably from about 700 to about 850 nanometers. Moreover, the imaging members of the present invention can be selected for electronic printing processes with gallium arsenide diode lasers, light emitting diode (LED) arrays, which typically function at wavelengths of from about 660 to about 830 nanometers.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as, for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as, for example, polycarbonate materials commercially available as MAKROLON®.

The thickness of the substrate layer depends on many factors, including economical considerations, thus this layer may be of substantial thickness, for example over 3,000 microns, or of a minimum thickness. In one embodiment, the thickness of this layer is from about 75 microns to about 300 microns.

In embodiments of the present invention, it is desirable to select as the coating solvents ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

As optional adhesives usually in contact with the supporting substrate, there can be selected various known substances inclusive of polyesters as indicated herein, polyamides, poly(vinyl butyral), poly(vinyl alcohol), polyurethane and polyacrylonitrile. This layer is of a suitable thickness, for example a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected as the charge transport component include molecules of the following formula

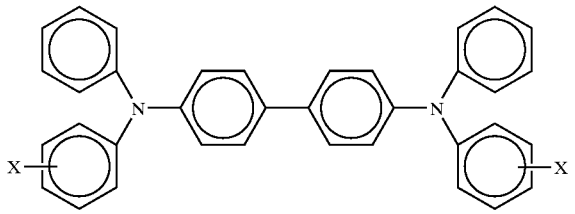

wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport molecules can be selected, reference for example U.S. Pat. Nos. 4,921,773 and 4,464,450, the disclosures of which are totally incorporated herein by reference.

Polymer binder examples for the charge transport include components, as illustrated, for example, in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins with a molecular weight of from about 20,000 to about 100,000 with a molecular weight, preferably $M_w$ of from about 50,000 to about 100,000 being particularly preferred.

Also included within the scope of the present invention are methods of imaging and printing with the photoresponsive or photoconductive members illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing, for example, by heat the image thereto. In those environments wherein the member is to be used in a printing mode, the imaging method is similar with the exception that the exposure step can be accomplished with a laser device or image bar.

Light shock refers, for example, to a phenomena in which a photoresponsive imaging member when exposed to room light exhibits an increase in dark decay, depletion, increased sensitivity, collapse of the photoinduced discharge curve (PIDC) tail, and reduced residual potential $V_{residual}$. The exposure to room light, may occur, for example, during installation of the photoreceptor or during servicing of a machine, such as a xerographic machine. Thus, for example, during belt replacement or machine maintenance, nonuniform exposure of the photoreceptor to room light can result in nonuniformity in the electrical properties of the imaging member. A difference in electrical properties between exposed areas of an imaging member is undesirable because it can cause nonuniform image potentials which in turn leads to the formation of nonuniform toner images when the light shocked imaging member is subsequently utilized for electrophotographic imaging. The light shock problem is particularly serious in imaging members containing phthalocyanines particles, such as hydroxygallium phthalocyanine or alkoxygallium phthalocyanine, as photogenerating pigments which, for example, dispersed in a polymer binder in the charge generating layer. For high quality imaging, the nonuniformity induced by light shock is undesirable.

The following Examples are being submitted to illustrate embodiments of the present invention. These Examples are intended to be illustrative only and are not intended to limit the scope of the present invention. Also, temperatures are in degrees Centigrade, and parts and percentages are by weight unless otherwise indicated.

EXAMPLE I

Layered photoconductive imaging members were prepared by the following procedure. A titanized MYLAR® substrate of 75 microns in thickness with a gamma amino propyl triethoxy silane layer, 0.1 micron in thickness, thereover, and E. I. DuPont 49,000 polyester adhesive thereon in a thickness of 0.1 micron was used as the base conductive film. A hydroxygallium phthalocyanine charge generation layer (CGL) was prepared as follows: 0.55 gram of HOGaPc(V) pigment was mixed with 0.58 gram of poly(styrene-b-4-vinylpyridine)polymer and 20 grams of toluene in a 60 milliliter glass bottle containing 70 grams of approximately 0.8 millimeter diameter glass beads. The bottle was placed in a paint shaker and shaken for 2 hours. The resultant pigment dispersion was coated using a #8 wire rod onto a titanized MYLAR® substrate of 75 microns in thickness, which had a gamma amino propyl triethoxy silane layer, 0.1 micron in thickness, thereover, and E. I. DuPont 49,000 polyester adhesive thereon in a thickness of 0.1 micron was used as the base conductive film. Thereafter, the photogenerator layer formed was dried in a forced air oven at 100° C. for 10 minutes.

A transport layer solution was generated by mixing 10 grams of N,N'-diphenyl-N,N'-bis(3-methylphenyl)-1,1-biphenyl-4,4'-diamine (TPD), 10 grams of polycarbonate resin (available as MAKROLON® 5705 from Bayer A. G.), and 133 grams of methylene chloride. The solution was placed on a paint shaker and shaken for 4 to 5 hours. The transport solution was coated onto the above photogenerating layer using a film applicator of 10 mil gap. The resulting members were dried at 115° C. in a forced air oven for 60 minutes. The final dried thickness of the transport layer was about 25 microns.

The xerographic electrical properties of the above prepared photoconductive imaging member and other similar members can be determined by known means, including electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter. The photosensitivity of the imaging member is usually provided in terms of the amount of exposure energy in ergs/cm$^2$, designated as $E_{1/2}$, required to achieve 50 percent photodischarge from $V_{ddp}$ to half of its initial value. The higher the photosensitivity, the smaller is the $E_{1/2}$ value. Another electrical property of the imaging member, designated as $E_{7/8}$, is the amount of exposure energy, in ergs/cm$^2$, required to achieve 87.5 percent or ⅞ discharge. This is equivalent to discharging an imaging member from −800 Volts to −100 Volts. The device was finally exposed to an erase lamp of appropriate light intensity and any residual potential ($V_{residual}$) was measured. The imaging members were tested with an exposure monochromatic light at a wavelength of 780 nanometers and an erase light with the wavelength of 600 to 800 nanometers. The imaging member had a dark decay of 24 volts/second, a $V_{residual}$ of −14 volts, an $E_{1/2}$ of 1.41 ergs/cm$^2$ and an $E_{7/8}$ of 3.24 ergs/cm$^2$.

EXAMPLE II

A hydroxygallium phthalocyanine (HOGaPc(V)) charge generator layer was prepared following the processes as described in Example I. A transport layer solution was generated by mixing 10 grams of N,N'-diphenyl-N,N'-bis (3-methylphenyl)-1,1-biphenyl-4,4'-diamine (TPD), 10 grams of polycarbonate resin (available as MAKROLON 5705® from Bayer A. G.), about 20 milligrams of 3,3',5,5'-tetra-tert-butyl-4,4'-diphenoquinone (DPQ) dopant and 133 grams of methylene chloride. The solution was placed on a paint shaker and shaken for 4 to 5 hours. The resulting transport solution was coated onto the above photogenerating layer using a film applicator of 10 mil gap and the resulting members were dried at 115° C. in a forced air oven for 60 minutes. The final dried thickness of the transport layer was about 25 microns thick and contained about 0.1 weight percent of the DPQ dopant.

The electrical properties of the above generated members were measured in accordance with the procedure described in Example I. The imaging member had a dark decay of 26 volts/second, a $V_{residual}$ of −26 volts, an $E_{1/2}$ of 1.46 ergs/cm$^2$ and an $E_{7/8}$ of 3.46 ergs/cm$^2$.

EXAMPLE III

A hydroxygallium phthalocyanine (HOGaPc(V)) charge generator layer was prepared following the processes as described in Example I. A transport layer solution was generated by mixing 10 grams of N,N'-diphenyl-N,N'-bis (3-methylphenyl)-1,1-biphenyl-4,4'-diamine (TPD), 10 grams of polycarbonate resin (available as MAKROLON® 5705 from Bayer A. G.), about 100 milligrams of 3,3',5,5'-tetra-tert-butyl-4,4'-diphenoquinone and 133 grams of methylene chloride. The solution was placed on a paint shaker and shaken for 4 to 5 hours. The resulting transport solution was coated onto the above photogenerating layer using a film applicator of 10 mil gap. The resulting members were dried at 115° C. in a forced air oven for 60 minutes. The final dried thickness of the transport layer was about 25 microns thick, and which final layer contained about 0.5 weight percent of the DPQ dopant.

The electrical properties of the above member were measured in accordance to the procedure described in Example I. The imaging member had a dark decay of 22 volts/second, a $V_{residual}$ of −30 volts, an $E_{1/2}$ of 1.49 ergs/cm$^2$ and an $E_{7/8}$ of 3.65 ergs/cm$^2$.

EXAMPLE IV

A hydroxygallium phthalocyanine (HOGaPc(V)) charge generator layer was prepared by following the processes as described in Example I. A transport layer solution was generated by mixing 10 grams of N,N'-diphenyl-N,N'-bis (3-methylphenyl)-1,1-biphenyl-4,4'-diamine (TPD), 10 grams of polycarbonate resin (available as MAKROLON® 5705 from Bayer A. G.), about 200 milligrams of 3,3',5,5'-tetra-tert-butyl-4,4'-diphenoquinone and 133 grams of methylene chloride. The resulting solution was placed on a paint shaker and shaken for 4 to 5 hours. The transport solution was coated onto the above photogenerating layer using a film applicator of 10 mil gap and the resulting member was dried at 115° C. in a forced air oven for 60 minutes. The final dried thickness of the transport layer was about 25 microns thick, and this final layer contained 0.9 to 1 weight percent of the dopant DPQ.

The electrical properties of the above member were measured in accordance with the procedure described in Example I. The imaging member had a dark decay of 22 volts/second, a $V_{residual}$ of −35 volts, an $E_{1/2}$ of 1.46 ergs/cm$^2$ and an $E_{7/8}$ of 3.75 ergs/cm$^2$.

EXAMPLE V

A hydroxygallium phthalocyanine (HOGaPc(V)) charge generator layer was prepared by following the processes as described in Example I. A transport layer solution was generated by mixing 10 grams of N,N'-diphenyl-N,N'-bis (3-methylphenyl)-1,1-biphenyl-4,4'-diamine (TPD), 10 grams of polycarbonate resin (available as MAKROLON® 5705 from Bayer A. G.), about 200 milligrams of 5,6,11, 12-tetraphenyinaphthacene (Rubrene) and 133 grams of methylene chloride. The solution was placed on a paint shaker and shaken for 4 to 5 hours. The transport solution was coated onto the above photogenerating layer using a film applicator of 10 mil gap. The resulting member was dried at 115° C. in a forced air oven for 60 minutes. The final dried thickness of transport layer was about 25 microns thick and this layer contained 1 weight percent of the dopant Rubrene.

The electrical properties of the above resulting photoconductive member were measured in accordance with the procedure described in Example I. The imaging member had a dark decay of 30 volts/second, a $V_{residual}$ of −10 volts, an $E_{1/2}$ of 1.30 ergs/cm$^2$ and an $E_{7/8}$ of 3.23 ergs/cm$^2$.

EXAMPLE VI

A hydroxygallium phthalocyanine (HOGaPc(V)) charge generator layer was prepared by following the processes as described in Example I. A transport layer solution was generated by mixing 10 grams of N,N'-diphenyl-N,N'-bis (3-methylphenyl)-1,1-biphenyl-4,4'-diamine (TPD), 10 grams of polycarbonate resin (available as MAKROLON® 5705 from Bayer A. G.), about 200 milligrams of 2,2'-[cyclohexylidenebis[(2-methyl-4,1-phenylene)azo]]bis[4-cyclohexyl-(9Cl)] (Oil Yellow 129) and 133 grams of methylene chloride. The solution was placed on a paint shaker and shaken for 4 to 5 hours. The transport solution was coated onto the above photogenerating layer using a film applicator of 10 mil gap. The resulting member was dried at 115° C. in a forced air oven for 60 minutes. The final dried thickness of the transport layer was about 25 microns thick, and this layer contained 1 weight percent of the dopant comprised of the above Oil Yellow 129.

The electrical properties of the above member were measured in accordance with the procedure described in Example I. The imaging member had a dark decay of 24 volts/second, a $V_{residual}$ of −61 volts, an $E_{1/2}$ of 1.33 ergs/cm$^2$ and an $E_{7/8}$ of 3.92 ergs/cm$^2$.

EXAMPLE VII

Light Shock Measurement

The degree of light shocking of each of the imaging members of Examples I, II, III, IV, V, VI were measured in a xerographic scanner by recording the photodischarge properties before and after subjecting them to 1,000,000 ergs/cm$^2$ of light of wavelength between 400 nanometers to 500 nanometers. An imaging member with minimal resistance to light shock will exhibit a significant change in photodischarge properties after light shocking. An imaging member which exhibits light shock resistance will possess similar photodischarge properties before and after light shocking. Some of the pertinent electrical properties to observe are dark decay, $V_{residual}$, $E_{1/2}$ and $E_{7/8}$. The electrical properties of the imaging member of the above Examples I, II, III, IV, V, VI before and after light shocking are given in Table 1, Table 2, Table 3 and Table 4, with the device or member of Example I representing a control device with minimal light shock resistance.

TABLE 1

| Device | Dark Decay (V/sec) Before Light Shock | After Light Shock | Percent Change |
|---|---|---|---|
| Control Device from Example I | 24 | 34 | 42 |
| Device of Example II with 0.1 weight percent DPQ | 26 | 32 | 23 |
| Device of Example III with 0.5 weight percent DPQ | 22 | 28 | 27 |
| Device of Example IV with 1.0 weight percent DPQ | 22 | 26 | 18 |
| Device of Example V with 1.0 weight percent Rubrene | 30 | 42 | 40 |
| Device of Example VI with 1.0 weight percent Oil Yellow | 24 | 32 | 33 |

TABLE 2

| Device | $V_{residual}$ Before Light Shock | After Light Shock | Percent Change |
|---|---|---|---|
| Control Device from Example I | −14 | −2 | 85 |
| Device of Example II with 0.1 weight percent DPQ | −26 | −12 | 54 |
| Device of Example III with 0.5 weight percent DPQ | −30 | −22 | 27 |
| Device of Example IV with 1 weight percent DPQ | −35 | −27 | 23 |
| Device of Example V with 1 weight percent Rubrene | −10 | −9 | 10 |
| Device of Example VI with 1 weight percent Oil Yellow | −61 | −41 | 34 |

TABLE 3

| Device | $E_{1/2}$ Before Light Shock | After Light Shock | Percent Change |
|---|---|---|---|
| Control Device from Example I | 1.41 | 1.30 | 8 |
| Device of Example II with 0.1 weight percent DPQ | 1.46 | 1.39 | 5 |

TABLE 3-continued

| Device | $E_{1/2}$ Before Light Shock | After Light Shock | Percent Change |
|---|---|---|---|
| Device of Example III with 0.5 weight percent DPQ | 1.49 | 1.41 | 5 |
| Device of Example IV with 1 weight percent DPQ | 1.46 | 1.42 | 3 |
| Device of Example V with 1 weight percent Rubrene | 1.30 | 1.26 | 3 |
| Device of Example VI with 1 weight percent Oil Yellow | 1.33 | 1.25 | 6 |

TABLE 4

| Device | $E_{7/8}$ Before Light Shock | After Light Shock | Percent Change |
|---|---|---|---|
| Control Device from Example I | 3.24 | 2.59 | 20 |
| Device of Example II with 0.1 weight percent DPQ | 3.46 | 3.04 | 12 |
| Device of Example III with 0.5 percent percent DPQ | 3.65 | 3.35 | 9 |
| Device of Example IV with 1 weight percent DPQ | 3.75 | 3.35 | 11 |
| Device of Example V with 1 weight percent Rubrene | 3.23 | 2.85 | 12 |
| Device of Example VI with 1 weight percent Oil Yellow | 3.92 | 2.96 | 25 |

The resistance to light shock was observable as a reduction in the difference of the electrical properties before and after light shocking when compared to the control imaging member of Example I. The imaging members described in Examples II to VI exhibit varying degrees of light shock resistance. This resistance to light lock is particularly evident in the change in $V_{residual}$ before and after light shocking.

The difference in resistance to light shock between the imaging members described in Example III and those described in Example IV is minimal. The imaging member in Example IV possesses a somewhat increased amount of 3,3',5,5'-tetra-tert-butyl-4,4'-diphenoquinone, and possesses an increased residual voltage.

EXAMPLE VIII

Xerographic cycling tests were also performed by continuously charging, exposing and erasing the imaging members. The residual voltage of the imaging members described in Example II, Example III and Example IV were recorded to cycle-up. The amount of cycle-up in these Examples was somewhat proportional to the amount of 3,3',5,5'-tetra-tert-butyl-4,4'-diphenoquinone present in the imaging member. The imaging member described in Example III possessed similar light resistance to the imaging member described in Example IV, but it possessed more favorable residual voltage cycling stability (less cycle-up).

EXAMPLE IX

Layered photoconductive imaging members were prepared by the following procedure. A titanized MYLAR® substrate of 75 microns in thickness, which had a gamma amino propyl triethoxy silane layer, 0.1 micron in thickness, thereover, and E. I. DuPont 49,000 polyester adhesive thereon in a thickness of 0.1 micron was used as the base conductive film. The next coating applied was a charge generator layer containing 2.8 percent by weight hydroxygallium phthalocyanine particles dispersed in 2.8 percent by weight poly(4,4-diphenyl-1,1-cyclohexene carbonate) (PCZ-200, available from Mitsubishi Gas) having an optical density of 0.95 (a dried thickness of about 0.4 micrometer).

A transport layer solution was generated by mixing 10 grams of N,N'-diphenyl-N,N'-bis(3-methylphenyl)-1,1-biphenyl4,4'-diamine (TPD), 10 grams of polycarbonate resin (available as MAKROLON 5705® from Bayer A. G.), and 133 grams of methylene chloride. The solution was placed on a paint shaker and shaken for 4 to 5 hours. The transport solution was coated onto the above photogenerating layer using a film applicator of 10 mil gap. The resulting members were dried at 115° C. in a forced air oven for 60 minutes. The final dried thickness of transport layer was about 25 microns thick.

The electrical properties of the above prepared photoconductive member was measured in accordance to the procedure described in Example I. The imaging member had a dark decay of 36 volts/second, a $V_{residual}$ of −27 volts, an $E_{1/2}$ of 1.20 ergs/cm$^2$ and an $E_{7/8}$ of 2.99 ergs/cm$^2$.

EXAMPLE X

A hydroxygallium phthalocyanine (HOGaPc(V)) charge generator layer was prepared following the processes as described in Example IX. A transport layer solution was generated by mixing 10 grams of N,N'-diphenyl-N,N'-bis(3-methylphenyl)-1,1-biphenyl-4,4'-diamine (TPD), 10 grams of polycarbonate resin (available as MAKROLON 5705® from Bayer A. G.), about 200 milligrams of 3,3',5,5'-tetra-tert-butyl-4,4'-diphenoquinone and 133 grams of methylene chloride. The solution resulting was placed on a paint shaker and shaken for 4 to 5 hours, and was coated onto the above photogenerating layer using a film applicator of 10 mil gap. The resulting member was dried at 115° C. in a forced air oven for 60 minutes. The final dried thickness of the transport layer was about 25 microns thick, and this layer contained 0.9 weight percent of the dopant of DPQ.

The electrical properties of the photoconductor member were measured in accordance with the procedure described in Example I. The imaging member had a dark decay of 38 volts/second, a $V_{residual}$ of −22 volts, an $E_{1/2}$ of 1.27 ergs/cm$^2$ and an $E_{7/8}$ of 3.04 ergs/cm$^2$.

EXAMPLE XI

Light Shock Measurement

The degree of light shocking of the imaging members of Examples IX and X were measured in accordance with the procedure described in Example VII. An imaging member which exhibits substantial light shock resistance will possess similar photodischarge properties before and after light shocking. Some of the pertinent electrical properties to observe are dark decay, $V_{residual}$, $E_{1/2}$ and $E_{7/8}$. The electrical properties of the imaging member of Examples IX and X before and after light shocking are given in Table 5, Table 6, Table 7 and Table 8.

TABLE 5

| Dark Decay (V/sec) | | | |
|---|---|---|---|
| Device | Before Light Shock | After Light Shock | Percent Change |
| Control Device from Example IX | 36 | 50 | 39 |
| Device of Example X with 1 weight percent DPQ | 38 | 44 | 16 |

TABLE 6

| $V_{residual}$ | | | |
|---|---|---|---|
| Device | Before Light Shock | After Light Shock | Percent Change |
| Control Device from Example I | 27 | 8 | 70 |
| Device of Example X with 1 weight percent DPQ | 22 | 18 | 18 |

TABLE 7

| $E_{1/2}$ | | | |
|---|---|---|---|
| Device | Before Light Shock | After Light Shock | Percent Change |
| Control Device from Example I | 1.20 | 1.15 | 4 |
| Device of Example X with 1 weight percent DPQ | 1.27 | 1.26 | 1 |

TABLE 8

| $E_{7/8}$ | | | |
|---|---|---|---|
| Device | Before Light Shock | After Light Shock | Percent Change |
| Control Device from Example I | 2.99 | 2.55 | 15 |
| Device of Example X with 1 weight percent DPQ | 3.04 | 2.98 | 2 |

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A photoconductive imaging member comprised of a supporting substrate, a photogenerating layer and a charge transport layer, and wherein said charge transport layer contains a component that substantially prevents light of a wavelength of about equal to or about less than 700 nanometers from interaction with said photogenerating layer, and wherein said charge transport layer is comprised of an arylamine.

2. A member in accordance with claim 1 wherein said photogenerating layer is of a thickness of from about 0.1 to about 10 microns, said transport layer is of a thickness of from about 5 to about 100 microns, and said interaction prevention prevents or minimizes the amount of said light from contacting said photogenerating layer.

3. A member in accordance with claim 1 wherein said component is present in an amount of from about 0.1 to about 5 weight percent.

4. A member in accordance with claim 3 wherein the photogenerating layer contains a photogenerating pigment present in an amount of from about 5 to about 95 weight percent, and wherein said component is a diphenoquinone present in an amount of from about 0.1 to about 1 weight percent.

5. A member in accordance with claim 4 wherein the thickness of said photogenerator layer is from about 0.1 to about 5 microns.

6. A member in accordance with claim 1 wherein said photogenerating layer contains a polymer binder.

7. A member in accordance with claim 6 wherein said binder is present in an amount of from about 50 to about 90 percent by weight, and wherein the total of all components is about 100 percent.

8. An imaging member in accordance with claim 6 wherein the binder is selected from the group consisting of polyesters, polyvinyl butyrals, polycarbonates, polystyrene-b-polyvinyl pyridine, and polyvinyl formulas.

9. A member in accordance with claim 1 wherein the photogenerating component is a hydroxygallium phthalocyanine that absorbs light of a wavelength of from about 370 to about 950 nanometers.

10. An imaging member in accordance with claim 1 wherein the supporting substrate is comprised of a conductive substrate comprised of a metal.

11. An imaging member in accordance with claim 10 wherein the conductive substrate is aluminum, aluminized polyethylene terephthalate or titanized polyethylene terephthalate.

12. An imaging member in accordance with claim 1 wherein said photogenerator is a metal free phthalocyanine.

13. An imaging member in accordance with claim 1 wherein said charge transport comprises

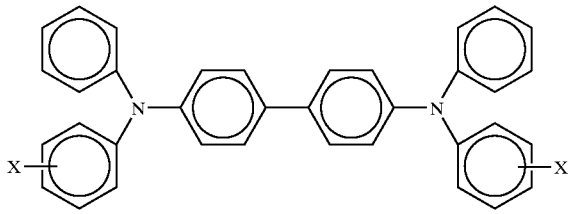

wherein X is selected from the group consisting of alkyl and halogen.

14. An imaging member in accordance with claim 13 wherein alkyl contains from about 1 to about 10 carbon atoms.

15. An imaging member in accordance with claim 13 wherein alkyl contains from about 1 to about 5 carbon atoms.

16. An imaging member in accordance with claim 13 wherein alkyl is methyl.

17. An imaging member in accordance with claim 1 wherein said component is the diphenoquinone 3,3',5,5'-tetra-tert-butyl-4,4'-diphenoquinone of the formula

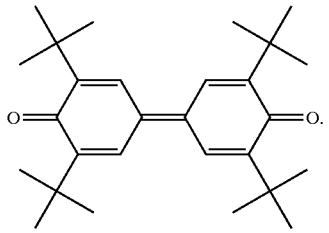

18. An imaging member in accordance with claim 1 wherein said component is a diphenoquinone, and wherein said diphenoquinone absorbs light of a wavelength of from about 400 to about 460 nanometers, and wherein this absorption enables the avoidance or minimization of light shock to said charge transport layer.

19. An imaging member in accordance with claim 1 wherein the photogenerating pigment present in said photogenerating layer is comprised of Type V hydroxygallium phthalocyanine prepared by hydrolyzing a gallium phthalocyanine precursor by dissolving said hydroxygallium phthalocyanine in a strong acid and then reprecipitating the resulting dissolved precursor in a basic aqueous media; removing any ionic species formed by washing with water; concentrating the resulting aqueous slurry comprised of water and hydroxygallium phthalocyanine to a wet cake; removing water from said wet cake by drying; and subjecting said resulting dry pigment to mixing with the addition of a second solvent to cause the formation of said hydroxygallium phthalocyanine.

20. An imaging member in accordance with claim 19 wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees.

21. An imaging member in accordance with claim 1 wherein said component is present in an amount of from about 0.5 to about 0.9 weight percent in said transport layer, and which transport layer contains a resin binder, and wherein said component is diphenoquinone.

22. A method of imaging which comprises generating an electrostatic latent image on the imaging member of claim 1, developing the latent image, and transferring the developed electrostatic image to a suitable substrate.

23. A method of imaging in accordance with claim 22 wherein the imaging member is exposed to light of a wavelength of from about 370 to about 950 nanometers.

24. A member in accordance with claim 1 wherein said photogenerating layer is situated between said substrate and said charge transport.

25. A member in accordance with claim 1 wherein said charge transport layer is situated between said substrate and said photogenerating layer.

26. A member in accordance with claim 1 wherein said component is a dopant of a diphenoquinon, and which dopant is present in said transport layer in an amount of from about 0.5 to about 0.9 weight percent, and which dopant prevents light of a wavelength of from about 400 to about 700 nanometers from entering said photogenerating layer.

27. A member in accordance with claim 26 wherein said photogenerating layer contains a hydroxygallium phthalocyanine.

28. An imaging apparatus containing a charging component, a development component, a transfer component, and a fixing component, and wherein said apparatus contains a photoconductive imaging member comprised of supporting substrate, and thereover a layer comprised of a photogenerator pigment and a charge transport layer, and which charge transport layer contains a diphenoquinone, and wherein said diphenoquinone substantially presents light of a wavelength of about equal to or about less than 700 nanometers from interaction with said photogenerating pigment, and wherein said charge transport layer is comprised of an arylamine.

29. A member comprised of a supporting substrate, a photogenerating layer and a charge transport layer, and wherein said charge transport layer contains a dopant that absorbs light of a wavelength of from about 400 to about 600 nanometers, and wherein said dopant is a diphenoquinone.

30. A process for substantially preventing light of a wavelength of about equal to or about less than 700 nanometers from interaction with a photogenerating pigment, and which process comprises the generation of a photogenerating layer, a charge transport layer thereover, and which photogonerating layer and charge transport layer are present on a supporting substrate, and wherein there is added to said charge transport layer a diphenoquinone, and wherein said charge transport layer is comprised of an arylamine.

31. A process in accordance with claim 30 wherein said diphenoquinone is 3,3',5,5'-tetra-tert-butyl-4,4'-diphenoquinone.

32. A process in accordance with claim 31 wherein said charge transport layer contains an aromataic amine, and said photogenerating layer contains a pigment of hydroxygallium phthalocyanine.

33. A process in accordance with claim 32 wherein said arylamine is N,N'-diphenyl-N,N'-bis(3-methylphenyl)-1,1-blphenyl-4,4'-diamine.

* * * * *